US012286696B2

(12) United States Patent
Kong et al.

(10) Patent No.: US 12,286,696 B2
(45) Date of Patent: Apr. 29, 2025

(54) HOT ROLLED AND UNANNEALED FERRITIC STAINLESS STEEL SHEET HAVING EXCELLENT IMPACT TOUGHNESS, AND MANUFACTURING METHOD THEREFOR

(71) Applicant: POSCO, Pohang-si (KR)

(72) Inventors: Jung Hyun Kong, Pohang-si (KR); Hyun Woong Min, Yongin-si (KR); Mun-Soo Lee, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 712 days.

(21) Appl. No.: 17/276,360

(22) PCT Filed: Aug. 23, 2019

(86) PCT No.: PCT/KR2019/010784
§ 371 (c)(1),
(2) Date: Mar. 15, 2021

(87) PCT Pub. No.: WO2020/060051
PCT Pub. Date: Mar. 26, 2020

(65) Prior Publication Data

US 2022/0042151 A1 Feb. 10, 2022

(30) Foreign Application Priority Data

Sep. 19, 2018 (KR) ..... 10-2018-0112483

(51) Int. Cl.
*C22C 38/50* (2006.01)
*C21D 8/02* (2006.01)
(Continued)

(52) U.S. Cl.
CPC ..... *C22C 38/50* (2013.01); *C21D 8/0205* (2013.01); *C21D 8/0226* (2013.01);
(Continued)

(58) Field of Classification Search
CPC ..... C22C 38/001; C22C 38/02; C22C 38/06; C22C 38/18; C22C 38/40; C22C 38/42;
(Continued)

(56) References Cited

U.S. PATENT DOCUMENTS

2004/0055673 A1* 3/2004 Kimura ..... C22C 38/24 148/610
2017/0073799 A1* 3/2017 Nakamura ..... C22C 38/52
(Continued)

FOREIGN PATENT DOCUMENTS

EP 3124635 A1 2/2017
EP 3438308 A1 2/2019
(Continued)

OTHER PUBLICATIONS

International Search Report dated Dec. 26, 2019 issued in International Patent Application No. PCT/KR2019/010784 (with English translation).
(Continued)

*Primary Examiner* — Brian D Walck
*Assistant Examiner* — Danielle Carda
(74) *Attorney, Agent, or Firm* — Morgan, Lewis & Bockius LLP

(57) ABSTRACT

A non-annealed hot-rolled ferritic stainless steel sheet with excellent impact toughness includes, in percent (%) by weight of the entire composition, C: more than 0 and 0.03% or less, Si: 0.1 to 0.5%, Mn: 1.5% or less, P: 0.04% or less, Cr: 10.5 to 14%, Ni: more than 0 and 1.5% or less, Ti: 0.01 to 0.5%, Cu: more than 0 and 1.0% or less, N: more than 0 and 0.015% or less, Al: 0.1% or less, the remainder of iron (Fe) and other inevitable impurities, and satisfies the following equation (1), and the average grain size of the cross-sectional microstructure in the direction perpendicular to the rolling direction is 60 μm or less.
(Continued)

$$(1500 \leq (1001.5*C+950.6*Mn+1350.5*Ni+395.6*Cu-0.7*Si-1.0*Ti-0.1*Cr-1.0*P-1.0*Al+1020.5*N) \leq 2200). \quad (1).$$

17 Claims, 14 Drawing Sheets

(51) Int. Cl.

| | |
|---|---|
| ***C22C 38/00*** | (2006.01) |
| ***C22C 38/02*** | (2006.01) |
| ***C22C 38/06*** | (2006.01) |
| ***C22C 38/42*** | (2006.01) |

(52) U.S. Cl.
CPC ..... *C22C 38/001* (2013.01); *C22C 38/02* (2013.01); *C22C 38/06* (2013.01); *C22C 38/42* (2013.01); *C21D 2211/005* (2013.01)

(58) Field of Classification Search
CPC ..... C22C 38/50; C22C 38/04; C21D 8/0205; C21D 8/0226; C21D 2211/005
USPC ..... 419/112
See application file for complete search history.

(56) References Cited

U.S. PATENT DOCUMENTS

| | | | | |
|---|---|---|---|---|
| 2017/0107593 | A1* | 4/2017 | Hamada | C21D 8/0263 |
| 2019/0093192 | A1* | 3/2019 | Mitsunaga | C22C 38/38 |

FOREIGN PATENT DOCUMENTS

| | | | | |
|---|---|---|---|---|
| JP | H08-144021 | A | | 6/1996 |
| JP | 10-60543 | A | | 3/1998 |
| JP | H1060543 | A | * | 3/1998 |
| JP | 3922740 | B2 | | 3/2007 |
| JP | 6022097 | B1 | | 11/2016 |
| JP | 2016191150 | A | * | 11/2016 |
| KR | 10-2016-0123371 | A | | 10/2016 |
| WO | 2017/169011 | A1 | | 10/2017 |
| WO | 2018/158854 | A1 | | 9/2018 |

OTHER PUBLICATIONS

Chinese Office Action dated Sep. 24, 2021 issued in Chinese Patent Application No. 201980061482.2 (with English translation).
Extended European Search Report dated Jul. 13, 2021 issued in European Patent Application No. 19863359.6.
Chinese Office Action dated Apr. 12, 2022 issued in Chinese Patent Application No. 201980061482.2 (with English translation).

* cited by examiner

45

45

HOT ROLLED AND UNANNEALED FERRITIC STAINLESS STEEL SHEET HAVING EXCELLENT IMPACT TOUGHNESS, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2019/010784, filed on Aug. 23, 2019, which in turn claims the benefit of Korean Application No. 10-2018-0112483, filed on Sep. 19, 2018, the entire disclosures of which applications are incorporated by reference herein.

TECHNICAL FIELD

The present disclosure relates to a ferritic stainless steel hot-rolled thick material and a manufacturing method thereof, and more particularly, to a non-annealed hot-rolled ferritic stainless steel sheet having a thickness of 6 mm or more and having excellent impact characteristics, and a manufacturing method thereof.

BACKGROUND ART

Ferritic stainless steel has inferior workability, impact toughness and high temperature strength compared to austenitic stainless steel, but since it does not contain a large amount of Ni, it is inexpensive and has low thermal expansion. In recent years, it is preferred to use it for automobile exhaust system component materials. In particular, flanges for exhaust systems have recently been converted into ferritic stainless thick plates with improved corrosion resistance and durability due to micro-cracks and exhaust gas leakage problems.

Carbon steel has been used for exhaust system flanges so far, but the corrosion of carbon steel occurs rapidly, causing a problem of severe red rust on the outer surface and a rapid decrease in the stability of the material. To solve this problem, STS409L material containing more than 11% of Cr is being applied for flanges. STS409L material is a steel grade with excellent workability and prevention of sensitization of welds by stabilizing C, N in 11% Cr with Ti, and is mainly used at temperatures at 700° C. or less. STS409L material is the most widely used steel grade because it has some corrosion resistance even against the condensate component generated in the exhaust system of automobiles. However, 409L is a single-phase ferrite and has very poor low-temperature impact characteristics, and thus has a high defect rate due to brittle cracks during flange processing in winter.

In addition, as the thickness of ferritic stainless steel is thicker than that of austenitic stainless steel, workability and impact toughness are inferior. Therefore, ferritic stainless steel has a brittle crack or crack propagation during cold rolling to a target thickness after hot rolling, thereby causing fracture of the plate. When processing products such as flanges using STS409L thick plates with a thickness of 6.0 mm or more, there is a disadvantage in that impact properties are inferior, such as cracks generated by impacts. Due to this low impact property, STS409L steel with a thickness of 6.0 mm or more is a very difficult steel to manufacture and process.

In addition, during hot rolling, thick materials with a thickness of 6.0 mm or more have a problem in that it is difficult to obtain fine grains due to a lack of rolling reduction, and brittleness is further increased by formation of coarse grains and non-uniform grains, and the impact property is deteriorated.

DISCLOSURE

Technical Problem

The embodiments of the present disclosure solve the above problems, and thus provide a non-annealed hot-rolled ferritic stainless steel sheet with improved impact toughness by securing fine ferrite grains without hot-rolling annealing through alloy element composition control.

Technical Solution

In accordance with an aspect of the present disclosure, a non-annealed hot-rolled ferritic stainless steel sheet with excellent impact toughness, the ferritic stainless steel includes, in percent (%) by weight of the entire composition, C: more than 0 and 0.03% or less, Si: 0.1 to 0.5%, Mn: 1.5% or less, P: 0.04% or less, Cr: 10.5 to 14%, Ni: more than 0 and 1.5% or less, Ti: 0.01 to 0.5%, Cu: more than 0 and 1.0% or less, N: more than 0 and 0.015% or less, Al: 0.1% or less, the remainder of iron (Fe) and other inevitable impurities, and satisfying the following equation (1), and the average grain size of the cross-sectional microstructure in the direction perpendicular to the rolling direction is 60 μm or less.

$$1500 \leq (1001.5*C+950.6*Mn+1350.5*Ni+395.6*Cu-0.7*Si-1.0*Ti-0.1*Cr-1.0*P-1.0*Al+1020.5*N) \leq 2200 \quad (1)$$

Here, C, Mn, Ni, Cu, Si, Ti, Cr, P, Al and N mean the content (% by weight) of each element.

The non-annealed hot-rolled steel sheet may have a thickness of 6.0 to 25.0 mm.

The −20° C. Charpy impact energy may be 150 J/cm$^2$ or more.

The average size of grains having a misorientation between grains of the microstructure of 15 to 180° may be 60 μm or less.

The average size of grains having a misorientation between grains of the microstructure of 5 to 180° may be 30 μm or less.

The average size of grains having a misorientation between grains of the microstructure of 2 to 180° may be 20 μm or less.

The fraction of grain boundary having a misorientation between grains of the microstructure of 15 to 180° may be 55% or more.

The fraction of grain boundary having a misorientation between grains of the microstructure of 5 to 15° may be 25% or less.

The fraction of grain boundary having a misorientation between grains of the microstructure of 2 to 5° may be 16% or less.

In accordance with another aspect of the present disclosure, a manufacturing method of a non-annealed hot-rolled ferritic stainless steel sheet with excellent impact toughness, the method includes: heating the slab containing in percent (%) by weight of the entire composition, C: more than 0 and 0.03% or less, Si: 0.1 to 0.5%, Mn: 1.5% or less, P: 0.04% or less, Cr: 10.5 to 14%, Ni: more than 0 and 1.5% or less, Ti: 0.01 to 0.5%, Cu: more than 0 and 1.0% or less, N: more than 0 and 0.015% or less, Al: 0.1% or less, the remainder of iron (Fe) and other inevitable impurities, at 1,220° C. or less; rough rolling the heated slab; finishing rolling the rough rolled bar; and winding up a hot-rolled steel sheet, and the reduction ratio in the last rolling mill of the rough rolling is 27% or more, and the coiling temperature is 800° C. or less.

The slab may satisfy the following equation (1).

$$1500 \leq (1001.5*C+950.6*Mn+1350.5*Ni+395.6*Cu-0.7*Si-1.0*Ti-0.1*Cr-1.0*P-1.0*Al+1020.5*N) \leq 2200 \quad (1)$$

Here, C, Mn, Ni, Cu, Si, Ti, Cr, P, Al and N mean the content (% by weight) of each element.

The temperature of the rough rolled bar may be 1,020 to 970° C.

The finishing rolling end temperature may be 920° C. or less.

The thickness of the hot rolled steel sheet may be 6.0 to 25.0 mm.

The microstructure of the cross-section in the direction perpendicular to the rolling direction of the wound hot-rolled steel sheet may have an average size of grains having a misorientation between grains of 15 to 180° of 60 μm or less.

The microstructure of the cross-section in the direction perpendicular to the rolling direction of the wound hot-rolled steel sheet may have a fraction of grain boundary having a misorientation between grains of the microstructure of 15 to 180° of 55% or more.

Advantageous Effects

According to an embodiment of the present disclosure, the microstructure grain size of a hot-rolled ferritic stainless steel sheet having a thickness of 6.0 mm or more can be refined to exhibit a high Charpy impact energy value without hot-rolling annealing heat treatment.

DESCRIPTION OF DRAWINGS

FIG. 1 is an IPF (ND) EBSD photograph, FIG. 2 is an ODF photograph, and FIG. 3 is a high angle grain boundary photograph of misorientation of 15 to 180° between grains, FIG. 4 is a low angle grain boundary photograph of misorientation of 5 to 15° between grains, and FIG. 5 is a low angle grain boundary photograph of misorientation of 2 to 5° between grains.

FIG. 6 is an IPF (ND) EBSD photograph, FIG. 7 is an ODF photograph, and FIG. 8 is a high angle grain boundary photograph of misorientation of 15 to 180° between grains, FIG. 9 is a low angle grain boundary photograph of misorientation of 5 to 15° between grains, and FIG. 10 is a low angle grain boundary photograph of misorientation of 2 to 5° between grains.

MODES OF THE INVENTION

Figure 1:
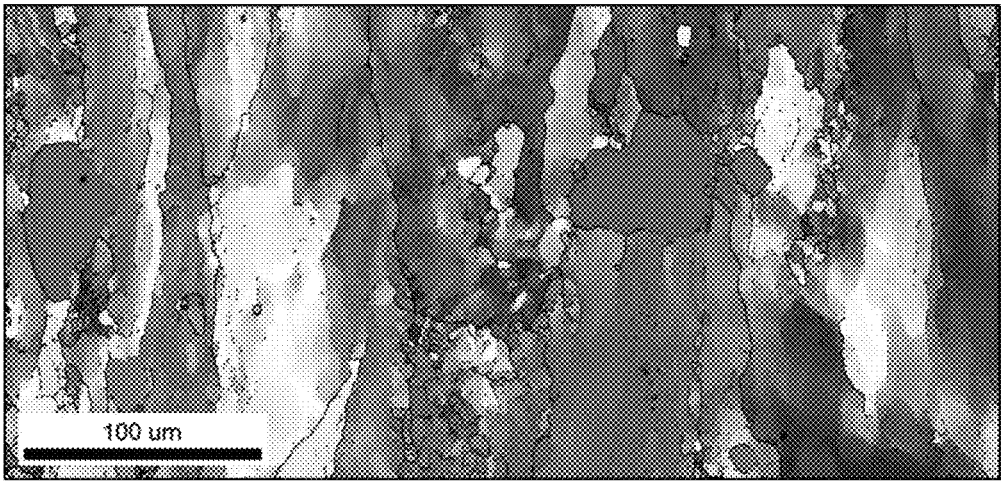
FIGS. 1 to 5 are photographs showing the cross-sectional microstructure of the N1 steel as a comparative example.

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

Also, when a part "includes" or "comprises" an element, unless there is a particular description contrary thereto, the part may further include other elements, not excluding the other elements.

An expression used in the singular encompasses the expression of the plural, unless it has a clearly different meaning in the context.

Various methods have been studied for improving the toughness of ferritic stainless hot rolled thick plates. First, there is a method of suppressing the Laves Phase, which deteriorates the brittleness of a material by lowering the hot-rolled coiling temperature or by performing a rapid cooling treatment such as water cooling. However, this method is difficult to apply to actual production, or causes bad coils such as scratch marks on the surface of the plate due to low temperature when coiling, or has a problem in that the deformation of the plate becomes non-uniform due to the rapid cooling rate, and partially cracks are generated. Therefore, this method has difficulties in practical production applications. Also, when hot rolling of ferritic stainless steel having a thickness of 6.0 mm or more, it is difficult to obtain a fine grain size due to insufficient rolling reduction compared to a steel plate with a thickness of 6.0 mm or less, and a problem of increasing brittleness due to formation of coarse grains and non-uniform grains has also been raised.

In the present disclosure, by adding Ni, Mn, or Cu to a hot-rolled thick plate having a thickness of 6.0 mm or more, the austenite phase transformation and recrystallization are induced by controlling the austenite phase fraction rather than the ferrite single phase at a hot-rolled reheating temperature of 1,220° C. or less to a certain amount or more, thereby securing the final fine ferrite grains. The non-annealed hot-rolled ferritic stainless steel sheet according to the present disclosure can control the average grain size of the cross-sectional microstructure of the hot-rolled steel sheet in the direction perpendicular to the rolling direction is 60 μm or less even though the hot-rolled annealing is not performed.

In this specification, 'ferritic stainless steel' means a hot-rolled non-annealed steel sheet with a thickness of 6.0 mm or more.

A non-annealed hot-rolled ferritic stainless steel sheet with excellent impact toughness according to an embodiment of present disclosure includes in percent (%) by weight of the entire composition, C: more than 0 and 0.03% or less, Si: 0.1 to 0.5%, Mn: 1.5% or less, P: 0.04% or less, Cr: 10.5 to 14%, Ni: more than 0 and 1.5% or less, Ti: 0.01 to 0.5%, Cu: more than 0 and 1.0% or less, N: more than 0 and 0.015% or less, Al: 0.1% or less, the remainder of iron (Fe) and other inevitable impurities.

Hereinafter, the reason for the numerical limitation of the alloy component element content in the embodiment of the present disclosure will be described. In the following, unless otherwise specified, the unit is % by weight.

The content of C is more than 0 and 0.03% or less, and the content of N is more than 0 and 0.015% or less.

In the case of C and N being present in an interstitial form as Ti(C, N) carbonitride-forming elements, Ti(C, N) carbonitride is not formed when C and N contents are high, and C and N present at a high concentration deteriorate elongation and low-temperature impact properties of the material. When the material is used at 600° C. or below for a long period of time after welding, intergranular corrosion occurs due to generation of $Cr_{23}C_6$ carbide, and therefore the content of C and N is preferably controlled to be 0.03% or less and 0.015 or less, respectively.

The content of Si is 0.1 to 0.5%.

Si is a deoxidizing element and is added at least 0.1% for deoxidation, and since it is an element forming a ferrite phase, the stability of the ferrite phase increases when the content increases. If the content of Si is more than 0.5%, steelmaking Si inclusions are increased and surface defects occur. For this reason, the Si content is preferably controlled to be 0.5% or less.

The content of Mn is 1.5% or less.

Mn is an austenite phase stabilizing element, and is added to secure a certain level of austenite phase fraction at hot rolling reheating temperature. However, when the content is increased, since precipitates such as MnS are formed to reduce pitting resistance, it is preferable to control the content of Mn to 1.5% or less.

The content of P is 0.04% or less.

Since P is included as an impurity in ferrochrome, a raw material for stainless steel, it is determined by the purity and quantity of ferrochrome. However, since P is a harmful element, it is preferable to have a low content, but since low-P ferrochrome is expensive, it is set to 0.04% or less, which is a range that does not significantly deteriorate the material or corrosion resistance. More preferably, it may be limited to 0.03% or less.

The content of Cr is 10.5 to 14%.

Cr is an essential element for ensuring corrosion resistance of stainless steel. When the content of Cr is low, corrosion resistance is lowered in an atmosphere of condensed water, and when the content is high, strength is increased and elongation and impact characteristics are lowered. In the present disclosure, since the target steel type to improve impact toughness is a ferritic stainless steel sheet containing 10.5 to 14% Cr, the content of Cr is limited to 10.5 to 14%.

The content of Ni is more than 0 and 1.5% or less.

Ni is an austenite phase stabilizing element, and is effective in suppressing the growth of pitting, and is effective in improving the toughness of hot-rolled steel sheets when added in small amounts. It is added to secure a certain level of austenite phase fraction at the hot-rolled reheating temperature related to Equation (1), which will be described later. However, a large amount of addition may cause material hardening and toughness reduction due to solid solution strengthening, and since it is an expensive element, it may be limited to 1.5% or less in consideration of the content relationship between Mn and Cu.

The content of Ti is 0.01 to 0.5%.

Ti is an effective element that fixes C and N to prevent intergranular corrosion. However, when the content of Ti is decreased, due to intergranular corrosion occurring at welded areas, corrosion resistance is decreased, and therefore Ti is preferably controlled to be at least 0.01% or more. However, when the Ti content is too high, steelmaking inclusions are increased, a number of surface defects such as scabs may occur due to an increase in steelmaking inclusions, a nozzle blocking phenomenon occurs in a continuous casting process. For this reason, the Ti content is controlled to be 0.5% or less and more preferably 0.35% or less.

The content of Cu is more than 0 and 1.0% or less.

Cu is an austenite phase stabilizing element, and is added to secure a certain level of austenite phase fraction at the hot-rolled reheating temperature related to Equation (1), which will be described later. When added in a certain amount, it serves to improve corrosion resistance, but excessive addition decreases toughness due to precipitation hardening, so it is preferable to limit it to 1.0% or less in consideration of the content relationship between Mn and Ni.

The content of Al is 0.1% or less.

Al is useful as a deoxidizing element and its effect can be expressed at 0.005% or more. However, the excessive addition causes the lowering of ductility and toughness at room temperature, so the upper limit is set to 0.1% and need not be contained.

In the present disclosure, the thickness of ferritic stainless steel sheet to improve impact toughness is 6.0 to 25.0 mm.

As described above, in the hot-rolled thick plate, there is a brittleness problem due to insufficient rolling reduction, and the thickness of the hot-rolled non-annealed ferritic stainless steel sheet according to the present disclosure for solving this is 6.0 mm or more. However, the upper limit may be 25.0 mm in consideration of the thickness of the rough-rolled bar after rough-rolling. Preferably, it may be 12.0 mm or less to be suitable for manufacturing use.

The non-annealed hot-rolled ferritic stainless steel sheet with excellent impact toughness according to an embodiment of the present disclosure satisfies the following equation (1).

$$1500 \leq (1001.5*C+950.6*Mn+1350.5*Ni+395.6*Cu-0.7*Si-1.0*Ti-0.1*Cr-1.0*P-1.0*Al+1020.5*N) \leq 2200 \quad (1)$$

Here, C, Mn, Ni, Cu, Si, Ti, Cr, P, Al, and N mean the content (% by weight) of each element.

By further satisfying Equation (1) within the range of the alloy composition described above, the austenite phase fraction can be controlled to 30% or more at the reheating temperature for hot rolling. For example, the reheating temperature is around 1,200° C., and the austenite phase fraction is more preferably 40% or more. By securing an austenite phase fraction of 30% or more in the reheating temperature range, austenite phase transformation and recrystallization are induced, and a final ferrite phase of a fine grain can be obtained through this.

The final ferrite microstructure can be divided into complete grains and sub-grains recrystallized according to misorientation between grains.

Sub-grains are quasi-grain formed to achieve thermodynamic equilibrium and reduce unstable energy that increases as dislocations are generated, and are also called contours. Non-uniform deformation and movement of atoms to a non-equilibrium position are generated by hot rolling, resulting in dislocation and stacking defects, and the presence of such defects increases the free energy of the system, so it recovers spontaneously without defects. Among the defects, edge dislocations can cause dislocation sliding even at relatively low temperatures. A low angle boundary with a small angle of the arranged mismatch boundaries can be formed, and a region surrounded by the low angle boundary is called a sub-grain.

For example, a grain having a misorientation between grains of 15 to 180° may be referred to as a complete grain recrystallized, and a grain of 2 to 15° may be referred to as a sub-grain. In the present disclosure, among sub-grains, grains with misorientation between grains of 2 to 5° and grains of 5 to 15° were further classified.

The reason for classifying sub-grains using misorientation between grains is to see the effect of sub-grains on impact toughness. In fact, in the case of the N1 steel as a comparative example in FIG. 1, the sum of the ratio of the Low Angle Grain Boundary (LAGB) of 2 to 15° accounts for about 70%, but it can be seen that the impact toughness is inferior compared to the inventive example. Through this, it can be seen that the High Angle Grain Boundary (HAGB) ratio is high like the N2 steel of the inventive example and its grain size should be fine.

If the alloy composition and equation (1) of the present disclosure are satisfied, fine ferritic grains can be secured without performing the hot rolling annealing process through austenite phase transformation and recrystallization.

An average grain size of a cross-sectional microstructure in the direction perpendicular to the rolling direction of a non-annealed hot-rolled ferritic stainless steel sheet according to an embodiment of the present disclosure satisfies 60 μm or less.

Specifically, the average size of complete grains with a misorientation between grains of 15 to 180° may be 60 μm or less, and grains of 5 to 180° misorientation including sub-grains with a misorientation between grains of 5 to 15° may have an average size of 30 μm or less. In addition, grains of 2 to 180° misorientation including sub-grains having a misorientation between grains of 2 to 5° may have an average size of 20 μm or less.

Sub-grain is a fine grain, so it affects the impact toughness, but a complete grain of recrystallized misorientation of 15 to 180° has a greater impact on the impact toughness. This is predicted because the impact energy is absorbed by the grain boundary, and the grain boundary of the complete grain can absorb more impact energy than the sub-grain. Actually, in Table 1 of the example below, in the case of the comparative example, the N1 steel, the sum of the ratio of the Low Angle Grain Boundary (LAGB) of 2 to 15° accounts for about 70%, but it can be seen that the impact toughness is inferior compared to the inventive example. Through this, it can be seen that the High Angle Grain Boundary (HAGB) ratio is high like the N2 steel of the inventive example and its grain size should be fine. That is, in order to secure excellent impact toughness, the grain boundary fraction with misorientation of 15 to 180° should be more than a certain fraction.

In the non-annealed hot-rolled ferritic stainless steel sheet according to the present disclosure, the fraction of the grain boundary in which misorientation between grains is 15 to 180° may be 55% or more compared to the total grain boundary.

In addition, it is preferable that the fraction of the grain boundary with misorientation between grains of 5 to 15° is 25% or less compared to the total grain boundary, and the grain boundary fraction with misorientation between grains of 2 to 5° is preferably 16% or less.

Accordingly, the non-annealed hot-rolled ferritic stainless steel sheet with excellent impact toughness of the present disclosure may indicate −20° C. Charpy impact energy of 150 J/cm$^2$ or more.

Next, a manufacturing method of a non-annealed hot-rolled ferritic stainless steel sheet with excellent impact toughness according to an embodiment of the present disclosure will be described.

A manufacturing method of a non-annealed hot-rolled ferritic stainless steel sheet with excellent impact toughness according to an embodiment of present disclosure includes heating the slab containing in percent (%) by weight of the entire composition, C: more than 0 and 0.03% or less, Si: 0.1 to 0.5%, Mn: 1.5% or less, P: 0.04% or less, Cr: 10.5 to 14%, Ni: more than 0 and 1.5% or less, Ti: 0.01 to 0.5%, Cu: more than 0 and 1.0% or less, N: more than 0 and 0.015% or less, Al: 0.1% or less, the remainder of iron (Fe) and other inevitable impurities, at 1,220° C. or less; rough rolling the heated slab; finishing rolling the rough rolled bar; and winding up a hot-rolled steel sheet.

The reason for limiting the numerical value of the alloy element content and the description of the thickness of the hot-rolled steel sheet are as described above.

In addition, the alloy composition of the slab may satisfy Equation (1) below as described above.

$$1500 \leq (1001.5*C+950.6*Mn+1350.5*Ni+395.6*Cu-0.7*Si-1.0*Ti-0.1*Cr-1.0*P-1.0*Al+1020.5*N) \leq 2200 \quad (1)$$

After heating the slab containing the alloy element of the above composition to 1,220° C. or less prior to hot rolling, the heated slab may be roughly rolled. The slab heating temperature is preferably 1,220° C. or less for dislocation generation through low temperature hot rolling, and when the slab temperature is too low, rough rolling is impossible, so the lower limit of the heating temperature may be 1,150° C. or higher.

At this time, it is possible to control the reduction ratio in the final rolling mill of rough rolling to 27% or more. In general, when the thickness of the hot-rolled steel sheet is thick, the reduction ratio is lowered, so that the amount of dislocation is reduced as the stress applied to the material is low. Therefore, as the thickness of the hot rolled steel sheet becomes thicker, the heating furnace temperature before hot rolling is made as low as possible, and when hot rolling, the load distribution of the rough rolling is moved to the rear end to perform a strong reduction at the rear end having a lower temperature than the front end. In this way, by strongly reducing so that the reduction ratio in the last rolling mill of rough rolling becomes 27% or more, it is possible to smoothly generate dislocations of the hot-rolled steel sheet.

The temperature of the rough rolled bar manufactured through the rough rolling process may be 1,020 to 970° C., and after finishing rolling to a thickness of 6.0 to 25.0 mm, it may be wound without hot rolling annealing heat treatment. The end temperature of the finishing rolling may be 960° C. or less. More preferably, the finishing rolling end temperature may be 920° C. or less.

The coiling temperature may be 800° C. or less. If the coiling temperature is higher than 800° C., it is preferable to wind it at 800° C. or less because it may correspond to the austenite phase region and a martensite phase may be generated during the cooling process.

As for the cross-sectional microstructure in the direction perpendicular to the rolling direction of the wound non-annealed hot-rolled steel sheet, the average size of grains having misorientation between grains of 15 to 180° may be 60 μm or less, and the grain boundary fraction of the misorientation may be 55% or more.

Hereinafter, it will be described in more detail through a preferred embodiment of the present disclosure.

Example

After heating the slab of the composition shown in Table 1 below to 1,200° C., the reduction ratio in the last rolling mill of the rough rolling was set to 30%, and the hot rolling was performed to a thickness of 10.0 mm so that the temperature of the rough rolled bar before the finishing rolling was about 1,000° C., and the temperature at the end of the finishing rolling was 910° C.

TABLE 1

| | Steel grade (wt %) | | | | | | | | | |
|---|---|---|---|---|---|---|---|---|---|---|
| | C | Si | Mn | P | Cr | Ni | Ti | Cu | N | Al |
| N1 | 0.006 | 0.52 | 0.15 | 0.024 | 11.1 | 0.8 | 0.19 | 0.05 | 0.0072 | 0.026 |
| N2 | 0.011 | 0.24 | 0.48 | 0.024 | 11.2 | 0.78 | 0.18 | 0.09 | 0.0100 | 0.020 |
| N3 | 0.007 | 0.23 | 0.50 | 0.023 | 11.0 | 0.79 | 0.17 | 0.19 | 0.0100 | 0.017 |

As shown in Table 2, a hot-rolled steel sheet of N1 to N3 steel was wound at 750° C., and the γ index value of Equation (1) and the corresponding austenite phase (γ) fraction were shown.

TABLE 2

| | Ac1(° C.) | Coiling temperature(° C.) | Equation (1) (γ index) | γ phase fraction |
|---|---|---|---|---|
| N1 | 800 | 750 | 1,286 | 3% |
| N2 | 777 | 750 | 1,629 | 33% |
| N3 | 767 | 750 | 1,752 | 43% |

1. Microstructure

The microstructure at the point of ¼ thickness of the TD cross section of the N1 steel with austenite phase (γ) fraction controlled to 3% and the N2 steel with austenite phase (γ) fraction controlled to 33% was observed and shown in Table 3 and FIGS. 1 to 10 below.

TABLE 3

| | Steel grade | grain average size(μm) | | | grain boundary fraction(%) | | |
|---|---|---|---|---|---|---|---|
| | | 15~180° | 5~180° | 2~180° | 15~180° | 5~15° | 2~5° |
| Comparative example | N1 | 150.1 | 98.2 | 76.1 | 30.1 | 22.4 | 47.5 |
| Inventive example | N2 | 54.2 | 16.5 | 13.2 | 60.0 | 24.1 | 15.9 |

Figure 2:
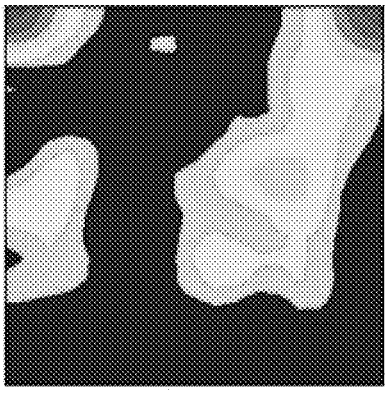
Figure 3:
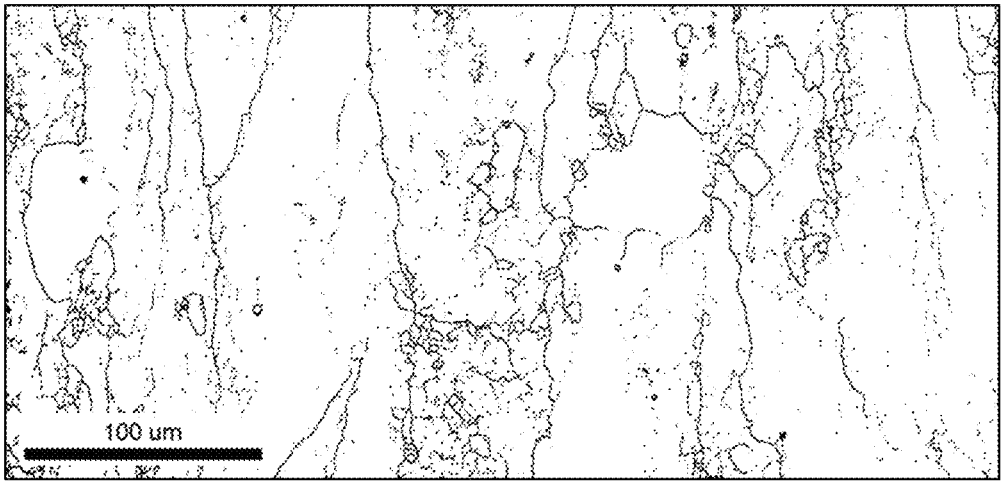
Figure 4:
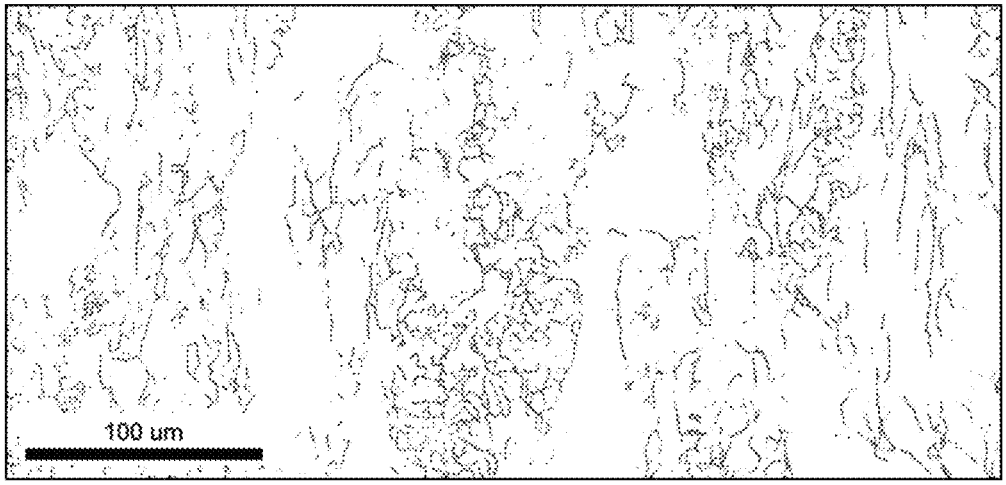
Figure 5:
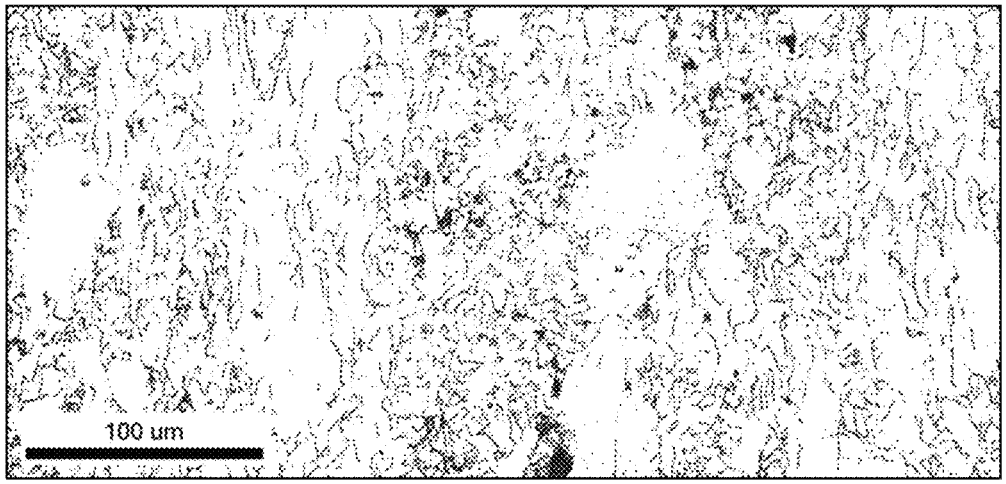

FIGS. 1 to 5 are photographs showing the cross-sectional microstructure of the N1 steel as a comparative example, FIG. 1 is an IPF (ND) EBSD photograph, FIG. 2 is an ODF photograph, and FIG. 3 is a high angle grain boundary photograph of misorientation of 15 to 180° between grains, FIG. 4 is a low angle grain boundary photograph of misorientation of 5 to 15° between grains, and FIG. 5 is a low angle grain boundary photograph of misorientation of 2 to 5° between grains.

Figure 6:
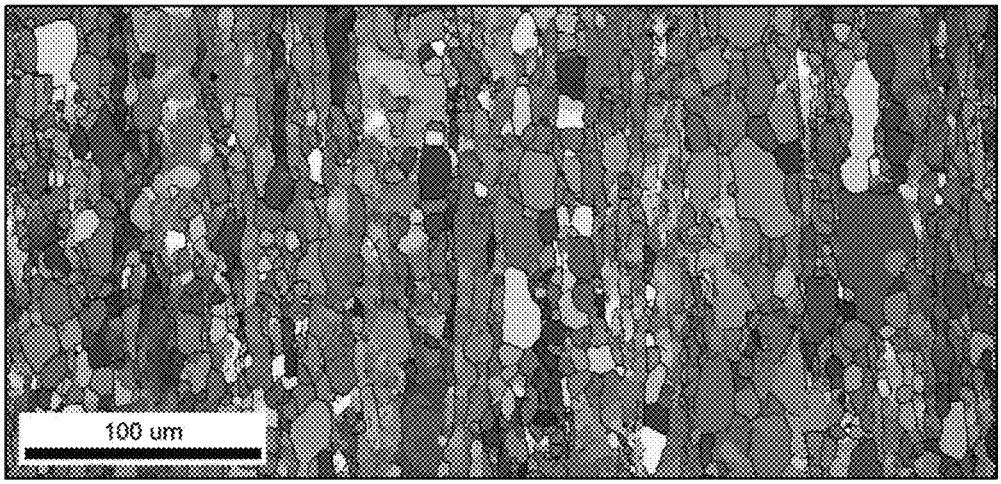
FIGS. 6 to 10 are photographs showing the cross-sectional microstructure of the N2 steel as an inventive example.
Figure 7:
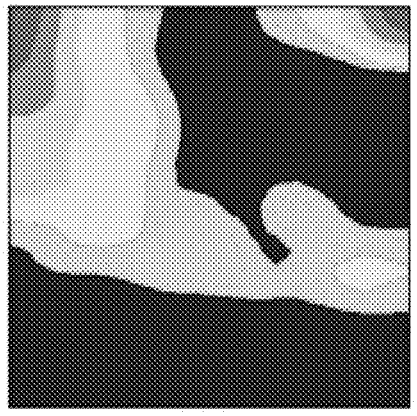
Figure 8:
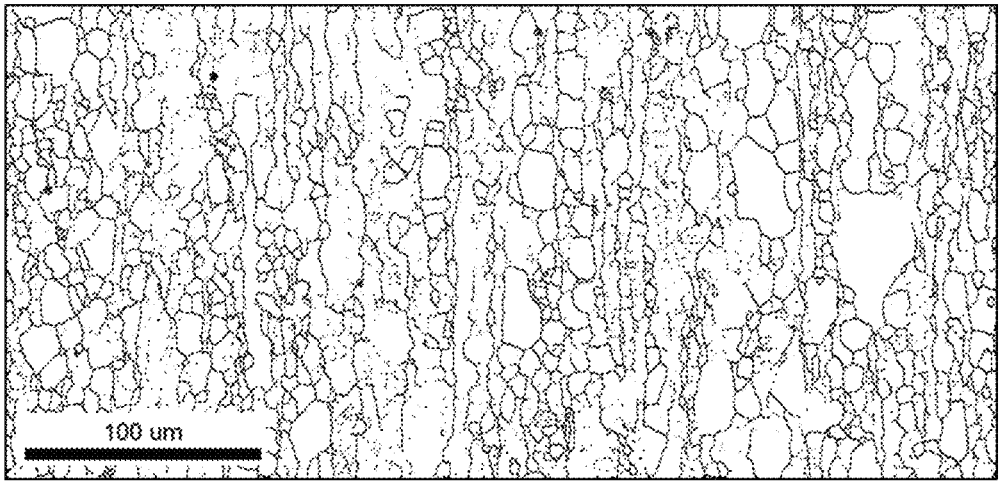
Figure 9:
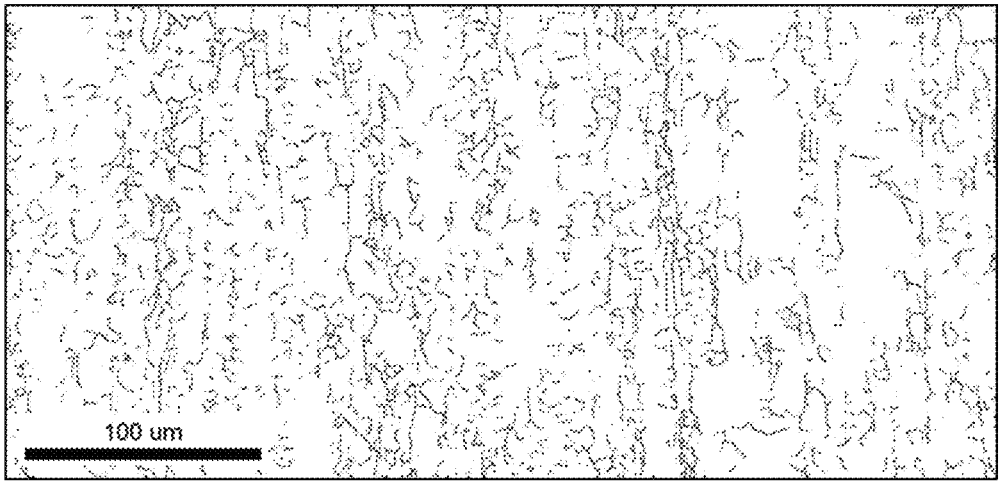
Figure 10:
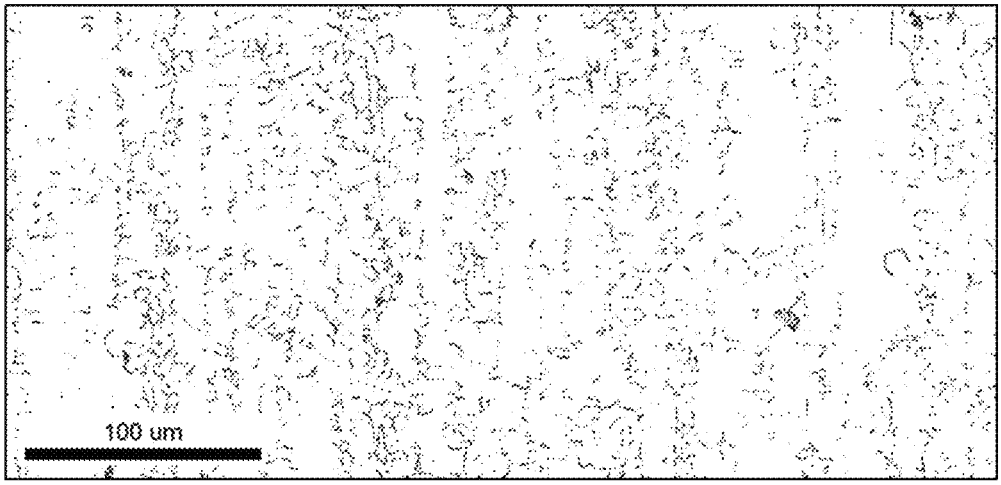

FIGS. 6 to 10 are photographs showing the cross-sectional microstructure of the N2 steel as an inventive example, FIG. 6 is an IPF (ND) EBSD photograph, FIG. 7 is an ODF photograph, and FIG. 8 is a high angle grain boundary photograph of misorientation of 15 to 180° between grains, FIG. 9 is a low angle grain boundary photograph of misorientation of 5 to 15° between grains, and FIG. 10 is a low angle grain boundary photograph of misorientation of 2 to 5° between grains.

As a result of observing the cross-sectional microstructure of the N1 steel as a comparative example, as shown in FIG. 3, the size of the ferrite grains observed by the High Angle Grain Boundary method of misorientation between grains of 15 to 180° was coarse to about 150 μm. On the other hand, the cross-section of the N2 steel as a inventive example showed a fine average grain size of 54 μm observed by the High Angle Grain Boundary method of 15 to 180° as shown in FIG. 8.

The average grain size of the misorientation between grains of 5~180° including 5~15° and the average grain size of 2~180° including 2~5° were also finer in the inventive example N2 steel than in the comparative example N1 steel.

As a result of observing each grain boundary fraction from FIGS. 3 to 5, which are photographs in which 15 to 180° HAGB, 5 to 15° LAGB, and 2 to 5° LAGB are separated from the N1 steel EBSD photograph of FIG. 1, the fraction of sub-grains (5~15°, 2~5°) was higher than that of complete recrystallized grains (15~180°). On the other hand, when observing each grain boundary fraction from FIGS. 8 to 10, which are photographs in which 15 to 180° HAGB, 5 to 15° LAGB, and 2 to 5° LAGB are separated from the N2 steel EBSD photograph of FIG. 6, the fraction of complete recrystallized grain)(15~180° was higher than that of sub-grain (5~15°, 2~5°).

It is possible to know how the fraction distribution of complete grain and sub-grain affects the impact energy value together with the impact energy test results below.

On the other hand, Table 4 below shows a case where the N2 steel is wound at 820° C., which is higher than the Ac1 temperature.

TABLE 4

| | Ac1(° C.) | Coiling temperature(° C.) | Equation (1) (γ index) | γ phase fraction |
|---|---|---|---|---|
| N2 | 777 | 820 | 1,629 | 33% |

Figure 11:
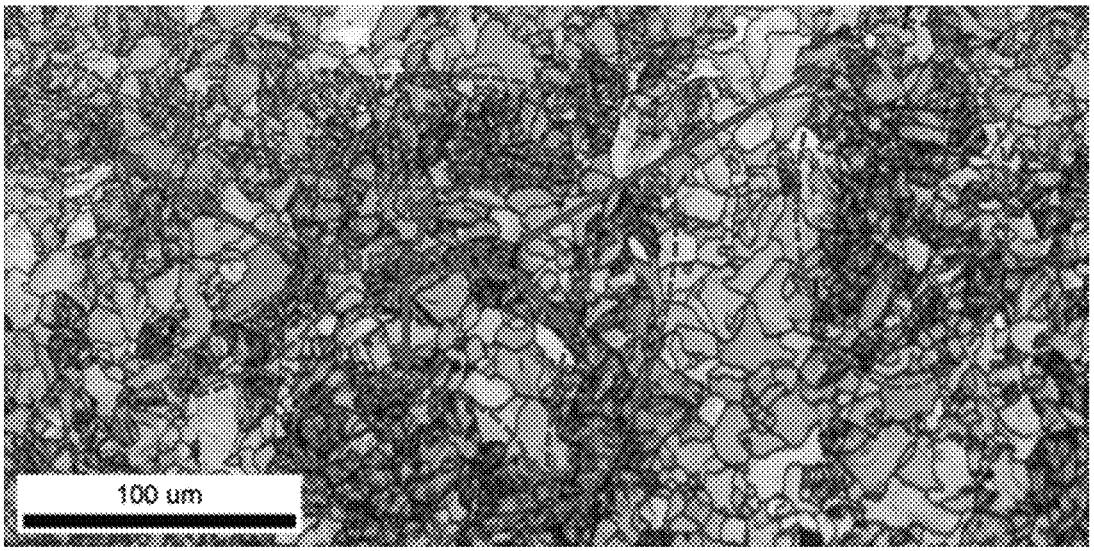
FIG. 11 is a photograph showing the cross-sectional microstructure of the N2 steel wound at 820° C.

FIG. 11 is a photograph showing the cross-sectional microstructure of the N2 steel wound at 820° C. As shown in Tables 2 and 4, the temperature of Ac1 of the N2 steel is about 777° C. In FIG. 6, when the coiling temperature of the N2 steel was set to 750° C., which is less than the Ac1 temperature, a martensite phase could not be found. However, referring to FIG. 11, it can be seen that when the coiling temperature is set to 820° C., which is higher than the Ac1 temperature, a reverse transformation martensite phase is generated together with fine ferrite grains. As described later, the impact absorption energy at 0° C. was also very inferior to 16 J/cm$^2$.

2. Impact Toughness Evaluation

A Charpy impact test was performed on the N1 to N3 steels at each temperature according to ASTM E 23 standards, and the results are shown in Table 5 below.

TABLE 5

| temperature | No. | Charpy impact energy(J/cm$^2$) Comparative example (N1) | Inventive example 1 (N2) | Inventive example 2 (N3) |
|---|---|---|---|---|
| −20° C. | 1 | 6.38 | 202.93 | 384.90 |
| | 2 | 6.75 | 178.34 | 384.90 |
| | 3 | 6.38 | 196.59 | 395.31 |
| 0° C. | 1 | 10.42 | 219.50 | 379.35 |
| | 2 | 8.57 | 374.38 | 379.96 |
| | 3 | 9.68 | 209.29 | 389.80 |
| 20° C. | 1 | 22.97 | 361.90 | 363.15 |
| | 2 | 24.93 | 203.56 | 361.28 |
| | 3 | 24.93 | 368.78 | 363.78 |

Figure 12:
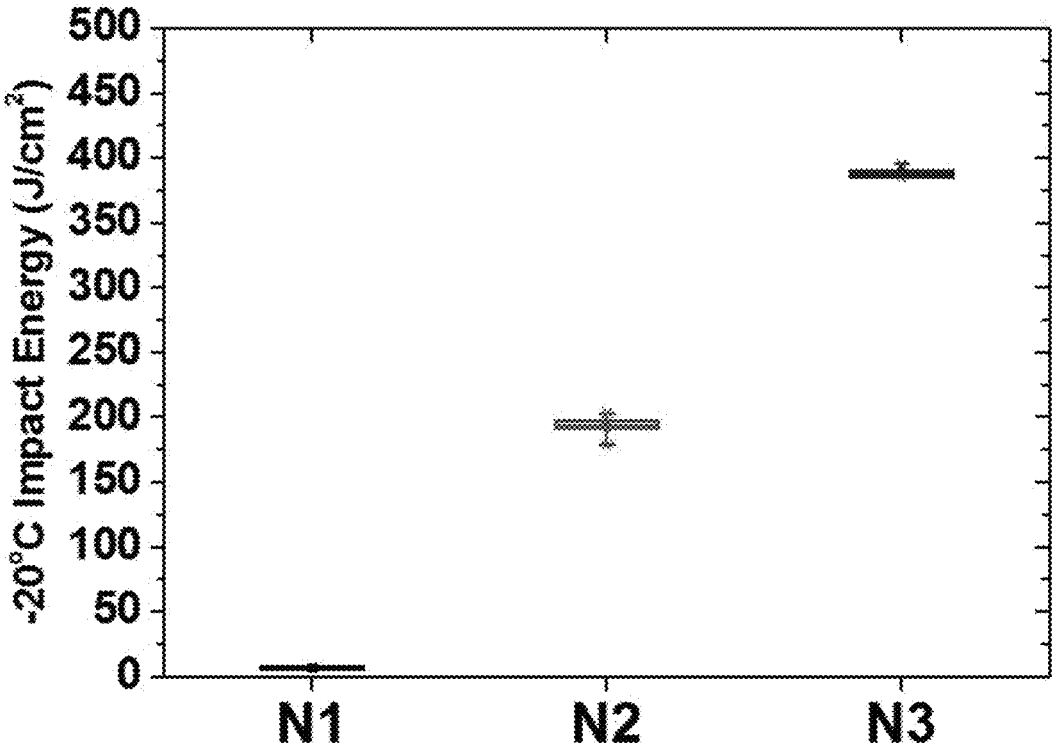
FIGS. 12 to 14 are graphs showing Charpy impact energy values for each temperature according to the austenite phase fraction at the hot rolling reheat temperature.
Figure 13:
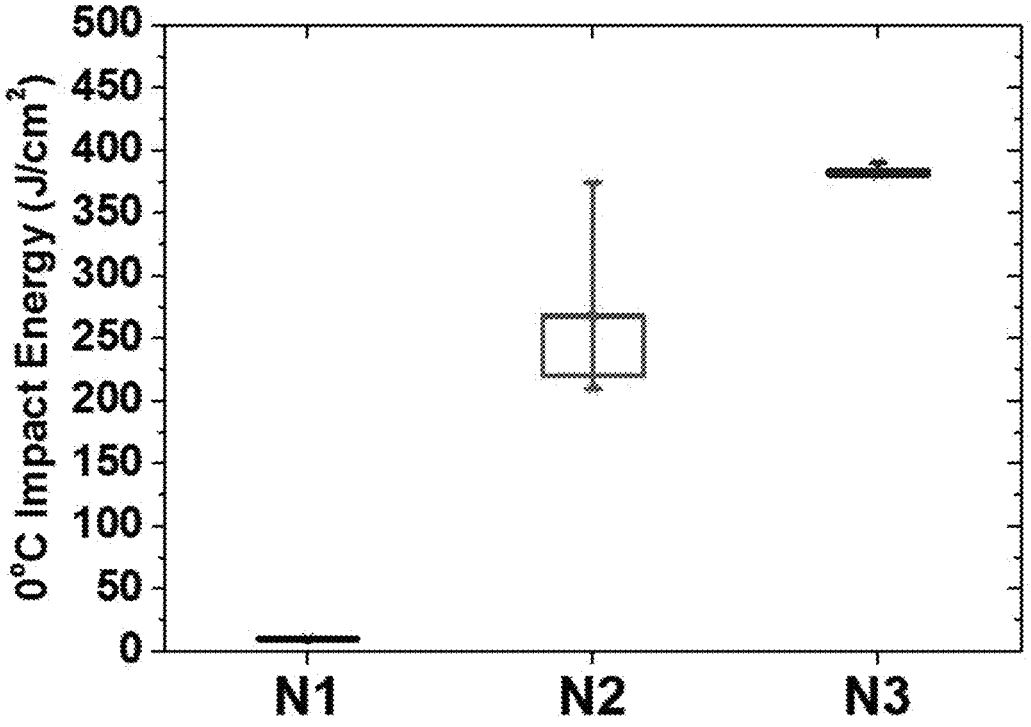
Figure 14:
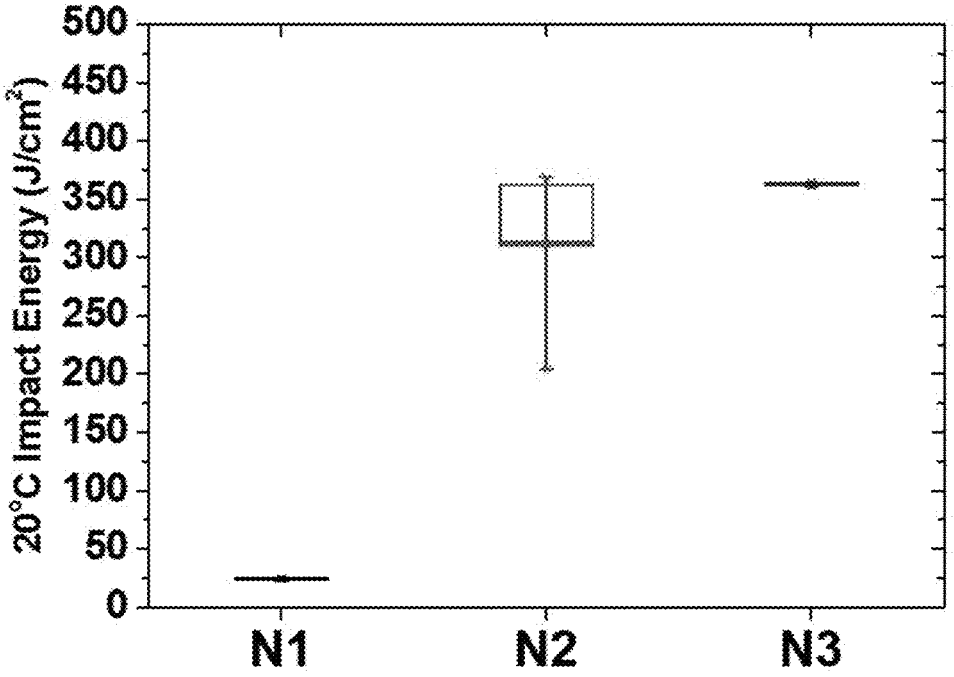

FIGS. 12 to 14 are graphs showing Charpy impact energy of N1 to N3 steels at −20° C., 0° C., and 20° C., respectively.

Referring to Table 5 and FIGS. 12 to 14, as a result of measuring the impact absorption energy at each temperature, the N1 steel, whose austenite phase fraction was controlled to 3% at 1,200° C., showed an impact energy value of 10 J/cm$^2$ or less at −20° C. and 0° C., and did not exceed 25 J/cm$^2$ even at a temperature of +20° C. However, according to the present disclosure, the 0° C. impact absorption energy values of the N2 and N3 steels that controlled the austenite phase fraction to 33% and 43% at 1,200° C. reheating temperature were all measured to be 200 J/cm$^2$ or more. The N3 steel showed a high impact absorption energy value of 350 J/cm$^2$ or more at all temperatures.

In the above description, exemplary embodiments of the present disclosure have been described, but the present disclosure is not limited thereto. Those of ordinary skill in the art will appreciate that various changes and modifications can be made without departing from the concept and scope of the following claims.

The invention claimed is:

1. A non-annealed hot-rolled ferritic stainless steel sheet, the ferritic stainless steel comprising, in percent by weight of the entire composition, C: more than 0 and 0.03% or less, Si: 0.1 to 0.5%, Mn: 1.5% or less, P: 0.04% or less, Cr: 10.5 to 14%, Ni: more than 0 and 1.5% or less, Ti: 0.01 to 0.5%, Cu: more than 0 and 1.0% or less, N: more than 0 and 0.015% or less, Al: 0.1% or less, the remainder of iron and other inevitable impurities, and satisfying the following equation (1), and an average grain size of a cross-sectional microstructure in a direction perpendicular to a rolling direction is 60 μm or less:

$$1500 \leq (1001.5*C+950.6*Mn+1350.5*Ni+395.6*Cu-0.7*Si-1.0*Ti-0.1*Cr-1.0*P-1.0*Al+1020.5*N) \leq 2200 \quad (1)$$

wherein C, Mn, Ni, Cu, Si, Ti, Cr, P, Al and N mean the content of each element in percent by weight, wherein the non-annealed hot-rolled ferritic stainless steel sheet has a thickness of 6.0 to 25.0 mm, wherein a fraction of grain boundary having a misorientation between grains of the microstructure of 15 to 180° is 55% or more, and wherein an austenite phase fraction is 30% or more at a reheating temperature for hot rolling.

2. The ferritic stainless steel sheet according to claim 1, wherein a −20° C. Charpy impact energy is 150 J/cm$^2$ or more.

3. The ferritic stainless steel sheet according to claim 1, wherein an average size of grains having the misorientation between the grains of the microstructure of 15 to 180° is 60 μm or less.

4. The ferritic stainless steel sheet according to claim 1, wherein an average size of grains having a misorientation between grains of the microstructure of 5 to 180° is 30 μm or less.

5. The ferritic stainless steel sheet according to claim 4, wherein the austenite phase fraction is 40% or more at the reheating temperature for the hot rolling.

6. The ferritic stainless steel sheet according to claim 4, wherein the reheating temperature for the hot rolling is 1,200° C. to 1,220° C.

7. The ferritic stainless steel sheet according to claim 4, wherein the ferritic stainless steel sheet is non-annealed.

8. The ferritic stainless steel sheet according to claim 1, wherein an average size of grains having a misorientation between grains of the microstructure of 2 to 180° is 20 μm or less.

9. The ferritic stainless steel sheet according to claim 1, wherein a fraction of grain boundary having a misorientation between grains of the microstructure of 5 to 15° is 25% or less.

10. The ferritic stainless steel sheet according to claim 1, wherein a fraction of grain boundary having a misorientation between grains of the microstructure of 2 to 5° is 16% or less.

11. The ferritic stainless steel sheet according to claim 1, wherein a −20° C. Charpy impact energy is 150 J/cm$^2$ or more, an average size of grains having the misorientation between the grains of the microstructure of 15 to 180° is 60 μm or less, an average size of grains having a misorientation between grains of the microstructure of 5 to 180° is 30 μm or less, an average size of grains having a misorientation between grains of the microstructure of 2 to 180° is 20 μm or less, a fraction of grain boundary having a misorientation between grains of the microstructure of 5 to 15° is 25% or less, and a fraction of grain boundary having a misorientation between grains of the microstructure of 2 to 5° is 16% or less.

12. A manufacturing method of a non-annealed hot-rolled ferritic stainless steel sheet with excellent impact toughness, the method comprising:

heating the slab containing in percent (%) by weight of the entire composition, C: more than 0 and 0.03% or less, Si: 0.1 to 0.5%, Mn: 1.5% or less, P: 0.04% or less, Cr: 10.5 to 14%, Ni: more than 0 and 1.5% or less, Ti: 0.01 to 0.5%, Cu: more than 0 and 1.0% or less, N: more than 0 and 0.015% or less, Al: 0.1% or less, the remainder of iron (Fe) and other inevitable impurities, at 1,220° C. or less;

rough rolling the heated slab;

finishing rolling the rough rolled bar; and winding up a hot-rolled steel sheet, and the reduction ratio in the last rolling mill of the rough rolling is 27% or more, the coiling temperature is Acl to 800° C.

13. The manufacturing method according to claim 12, wherein the slab satisfies the following equation (1), $$1500 \leq (1001.5*C+950.6*Mn+1350.5*Ni+395.6*Cu-0.7*Si-1.0*Ti-0.1*Cr-1.0*P-1.0*Al+1020.5*N) \leq 2200 \quad (1)$$

(Here, C, Mn, Ni, Cu, Si, Ti, Cr, P, Al and N mean the content (% by weight) of each element).

14. The manufacturing method according to claim 12, wherein the temperature of the rough rolled bar is 1,020 to 970° C., wherein the finishing rolling end temperature is 920° C. or less.

15. The manufacturing method according to claim 12, wherein the thickness of the hot rolled steel sheet is 6.0 to 25.0 mm.

16. The manufacturing method according to claim 12, wherein the microstructure of the cross-section in the direction perpendicular to the rolling direction of the wound hot-rolled steel sheet has an average size of grains having a misorientation between grains of 15 to 180° of 60 μm or less.

17. The manufacturing method according to claim 12, wherein the microstructure of the cross-section in the direction perpendicular to the rolling direction of the wound hot-rolled steel sheet has a fraction of grain boundary having a misorientation between grains of the microstructure of 15 to 180° of 55% or more.

* * * * *